US005964042A

United States Patent [19]

Carper

[11] Patent Number: 5,964,042

[45] Date of Patent: Oct. 12, 1999

[54] GABLE CLAMP DEVICE

[76] Inventor: Gary H. Carper, Rte. 1, Box 166, Hedgesville, W. Va. 25427

[21] Appl. No.: 08/991,620

[22] Filed: Dec. 16, 1997

Related U.S. Application Data

[60] Provisional application No. 60/032,984, Dec. 16, 1996.

[51] Int. Cl.[6] ..... G01C 15/10

[52] U.S. Cl. ..... 33/407

[58] Field of Search ..... 33/404, 407, 408, 33/409, 410, 413, 416, 518

[56] References Cited

U.S. PATENT DOCUMENTS

| | | | |
|---|---|---|---|
| 1,643,915 | 9/1927 | Angelilli | 33/408 |
| 2,629,178 | 2/1953 | Zinken | 33/410 |
| 2,809,434 | 10/1957 | Cordier | 33/407 |
| 2,811,778 | 11/1957 | Snyder | 33/407 |
| 2,991,557 | 7/1961 | Bongiovanni | 33/407 |
| 3,096,588 | 7/1963 | Cook | 33/410 |
| 3,571,931 | 3/1971 | Williams | 33/407 |
| 5,125,162 | 6/1992 | Prebeck | 33/408 |
| 5,129,150 | 7/1992 | Sorensen | 33/410 |
| 5,392,523 | 2/1995 | Hurt | 33/408 |

FOREIGN PATENT DOCUMENTS

| | | |
|---|---|---|
| 997633 | 1/1952 | France . |
| 1940755 | 2/1971 | Germany . |

*Primary Examiner*—G. Bradley Bennett
*Attorney, Agent, or Firm*—Richard C. Litman

[57] ABSTRACT

A gable clamp device for holding a brick mason's guide line while a bricked-in gable is being constructed. The gable clamp device includes of a pair of gable clamps, a pair of angle irons, and a mason's guide line. The angle irons are elongated beams having a prismatic L-shape which are adapted to be attached to the underside of a gable so that one portion of the angle iron lies flat against the underside of the gable and the other portion extends perpendicularly therefrom. The gable clamps have a line holder and a channel shaped clamping portion that allows each clamp to be attached to a gable face board or to an angle iron. When the gable clamp device is used to construct a bricked-in gable with a conventional 4.5 inch roof overhang, the gable clamps may be attached to the gable face boards. However, when the gable clamp device is used to construct a bricked-in gable with a roof overhang that is greater than 4.5 inches, the angle irons are attached to the underside of the gable about 4.5 inches from the wall being bricked-in and the gable clamps are attached to the angle irons and used in a similar fashion.

7 Claims, 3 Drawing Sheets

GABLE CLAMP DEVICE

CROSS-REFERENCE TO RELATED APPLICATION

This application claims the benefit of U.S. Provisional Patent Application Ser. No. 60/032,984, filed Dec. 16, 1996.

BACKGROUND OF THE INVENTION

1. Field of the Invention

The present invention relates to a gable clamp device for brick masons. More specifically, the invention relates to a gable clamp device which may be used with any size roof overhang to hold a mason's guide line at a desired level while a bricked-in gable is being constructed.

2. Description of Related Art

When constructing a bricked-in gable, it is desirable to use a level line extending from end to end of each course of bricks to be laid to insure that each course of bricks is laid evenly with no uneven widths of mortar and without wavy horizontal lines. Many devices for holding such a line, often called a mason's guide line, are known. These include apparatuses in which pairs of devices are attached to the gable face boards on opposite sides of the gable to hold a mason's guide line therebetween and devices which attach to the bricks at opposite ends of each course to hold a mason's guide line therebetween.

However, none of these discloses a device for holding a mason's guide line which utilizes a pair of angle irons adapted to be attached to the underside of the gable and a pair of modified gable clamps that may be clamped to the gable face boards or to the angle irons.

U.S. Pat. No. 2,811,778, issued Apr. 12, 1954 to Joseph A. Snyder, shows a device for holding a mason's guide line that utilizes a pair of line holding apparatuses which are slidably mounted in trackways attached to the gable face board. The '778 device has the disadvantage that when it is used with a gable with a large roof overhang, the mason's guide line will be held a considerable distance in front of each course of bricks thereby making it more difficult to lay each course of bricks evenly. The gable clamp device of the present invention solves this problem by utilizing angle irons that are adapted to be attached to the underside of the gable at a small distance from the wall being bricked-in so that the gable clamps attached to the angle irons hold the mason's guide line very close to each course of bricks as they are laid.

U.S. Pat. Nos. 2,809,434 (Cordier), 2,991,557 (Bongiovanni), and 3,571,931 (Williams) show devices for holding a mason's guide line that utilize pairs of clamps which are adapted to be attached to the gable face boards on opposite sides of the gable so that they may hold a mason's guide line therebetween. These devices are also impractical to use with a large roof overhang because they attach to the gable face boards which are the part of the gable most distant from the wall being bricked-in.

U.S. Pat. Nos. 5,125,162 (Prebeck), 5,129,150 (Sorensen), and 5,392,523 (Hurt), show apparatuses for holding mason's guide lines that utilize devices which are adapted to attach directly to previously laid courses of bricks at opposite ends thereof so that they may hold a mason's guide line therebetween. Unlike the present invention, these devices have the disadvantage that they may not be used to help insure that the first course of bricks laid is even and level with the necessary result that subsequent courses of bricks will not be level.

None of the above inventions and patents, taken either singularly or in combination, is seen to describe the instant invention as claimed. Thus a gable clamp device solving the aforementioned problems is desired.

SUMMARY OF THE INVENTION

The present invention is a gable clamp device for holding a brick mason's guide line while a bricked-in gable is being constructed. The device includes a pair of gable clamps and a pair of angle irons.

The angle irons are elongated metal strips having a securing beam and a clamping beam which are joined together to have an L-shaped cross section. The securing beam has a plurality of evenly spaced holes positioned along the longitudinal center thereof. The securing beam is attached flush against the underside of a gable by passing various fasteners, such as screws, nails and the like, through the plurality of holes. As such, the clamping beam extends perpendicularly from the gable.

The gable clamps have a line holder extending from a channel shaped clamping portion. The clamping portion has two spaced sidewalls, one of which is adapted to bear against the inside surface of the object the gable clamps are being attached to and one of which has a thumb screw extending therethrough with a clamping plate on its end that is adapted to bear against the outside surface of the object the gable clamps are being attached to.

The gable clamps of the present invention differ from standard gable clamps in that the thumb screw through one side wall of the clamping portion is long enough so that the clamping plate on its end may be brought to bear against the opposite sidewall of the clamping portion. This allows the gable clamp to be attached to the gable face boards or to the angle irons which are much thinner than the gable face boards.

When the gable clamp device of the present invention is used to construct a bricked-in gable with a conventional 4.5 inch roof overhang, the gable clamps may be attached to the gable face boards and used in a conventional fashion to hold the brick mason's guide line. However, when the gable clamp device is the present invention is used to construct a bricked-in gable with a roof overhang that is greater than 4.5 inches, the angle irons are provided and attached as a temporary track to the underside of the gable about 4.5 inches from the wall being bricked-in and the gable clamps are attached to the angle irons and used in the same fashion.

Accordingly, it is a principal object of the invention to provide a gable clamp device which may be used to hold a brick mason's guide line.

It is another object of the invention to provide a gable clamp device for holding a mason's guide line which may be used with any size roof overhang.

It is a further object of the invention to provide a gable clamp device which utilizes a pair of angle irons adapted to be attached to the underside of the gable to serve as a trackway for a pair of gable clamps adapted to be attached to the angle irons.

It is an object of the invention to provide improved elements and arrangements thereof in a gable clamp device for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
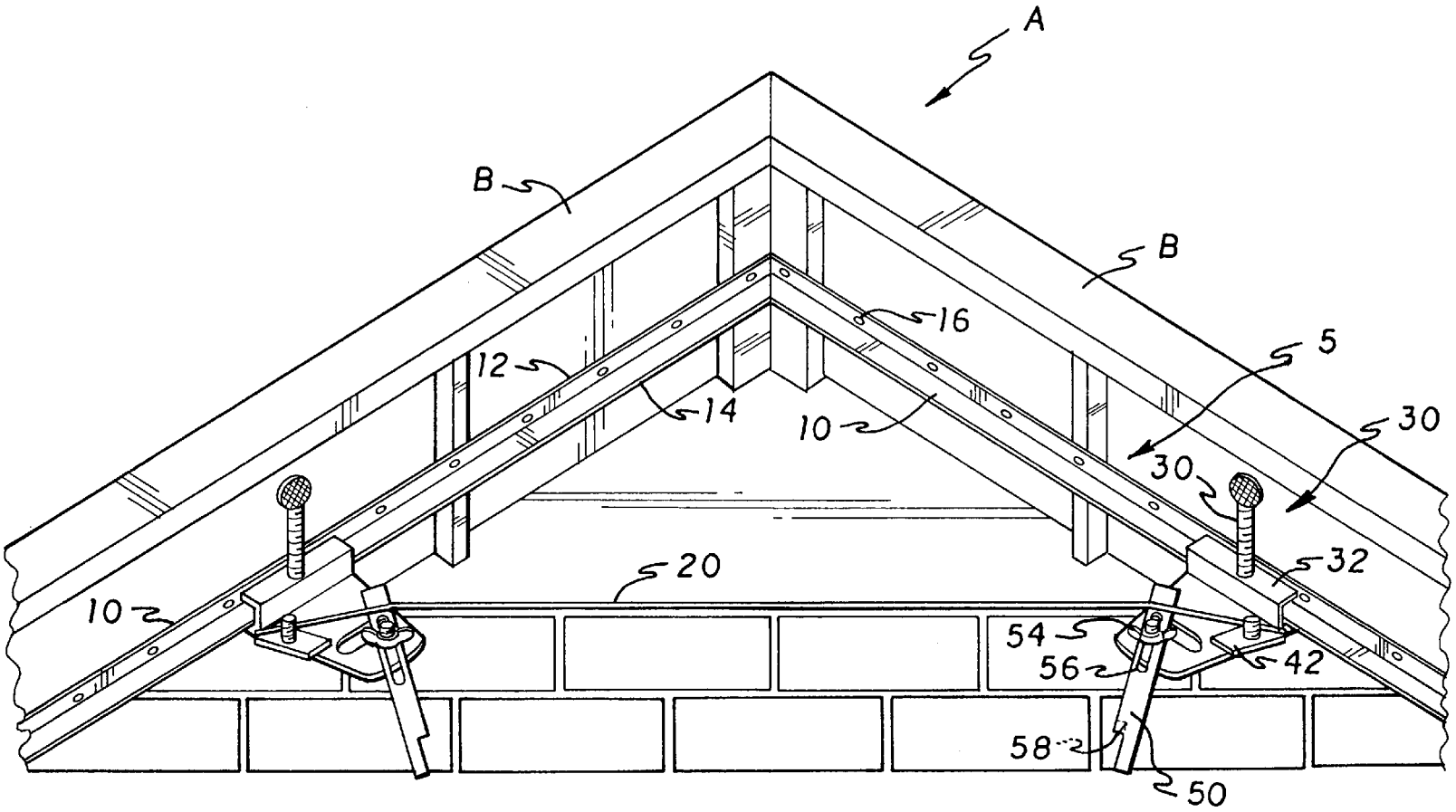
FIG. 1 is an environmental perspective view of the gable clamp device of the present invention.

The present invention, generally referred to as a gable clamp device 5, is used to aid in constructing a bricked in gable A as FIG. 1. illustrates. The gable clamp device 5 includes a pair of angle irons 10, a pair of gable clamps 30, and a mason's guide line 20. The angle irons 10 are elongated metal beams having a securing beam 12 and a clamping beam 14 which are joined together to form a prismatic L-shape. A plurality of holes 16 pass through the securing beam 12 at regular small intervals along the longitudinal center thereof so that the angle irons 10 may be attached to the underside of the gable A by driving nails, screws, or other mechanical fasteners through the holes 16 and into the underside of the gable A. By securing the angle irons 10 to the underside of the gable in this fashion, the securing beam 12 of the angle iron 10 lies flat against the underside of the gable A and the clamped member 14 extends perpendicularly therefrom.

Figure 3:
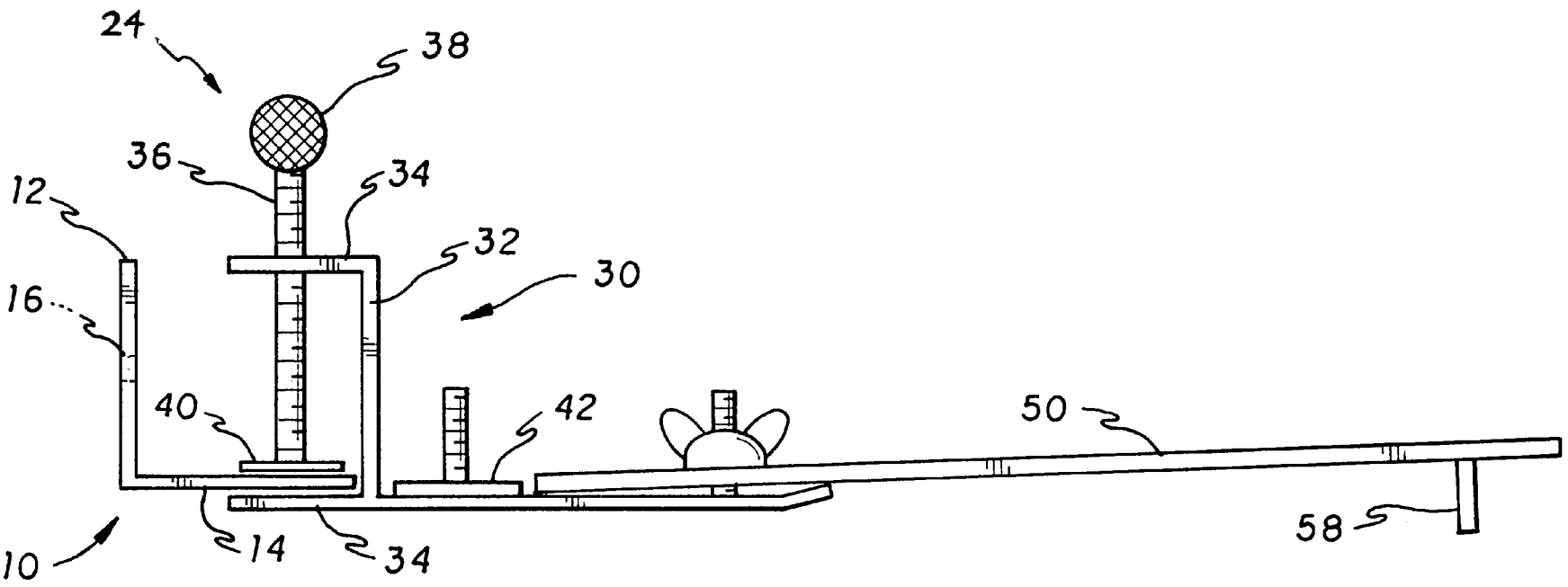
FIG. 3 is a side elevational view of the gable clamp device of FIG. 1.

Referring to FIG. 3 for greater detail, the gable clamp 30 is shown having a line holder 42 to hold the mason's guide line 20, and a fastener 24 to fasten the gable clamp 30 to the clamping beam 14 of the angle irons 10 or the gable face boards B. Conventional roof overhangs are approximately 4.5 inches, and in such cases the gable clamps 30 are clamped to the gable face boards B. However, if the roof overhang is much greater than 4.5 inches, the gable clamps 30 of the gable clamp device 5 are clamped to the angle irons 10. Details on the use of the gable clamp device 5 with conventional and unconventional roof overhangs are further discussed below.

The fastener 24 is made up of a channel shaped member 32 on the gable clamps 30. The channel shaped member 32 has two opposed sidewalls 34A and 34B which are spaced far enough apart to be placed around the edge of the gable face board B. A thumb screw 36 is provided having a finger grip 38 formed on one end, and, a clamping member 40 attached to the other end. The thumbscrew 36 is threaded and closely passes through one of the matingly threaded sidewalls 34A so that the clamping member 40 is disposed between the two opposed sidewalls 34A and 34B. Unlike conventional gable clamps, the thumb screw 36 used with the present invention is long enough so that the clamping member 40 may be brought to bear against the opposite sidewall 34B by turning the thumb screw with the finger grip 38.

This arrangement allows the gable clamp 30 to be attached to a structure such as a gable face board B or the angle irons 10 by placing the channel shaped member 32 over the edge of the structure and twisting the thumb screw 36 until the structure is clamped between the clamping member 40 and the opposite sidewall 34B. When clamping a thin structure, like the clamping beam 14 of the angle iron 10, conventional gable clamps are unable to clamp the structure because the thumb screw used is significantly shorter. Therefore, the clamping member of conventional gable clamps can not be brought close enough to the opposite sidewall to clamp a thin structure like the angle iron 10 therebetween.

The gable clamp 30 also has a leg 50 pivotally and slidably mounted thereon. The leg 50 has a slot 56 formed therethrough along the longitudinal center thereof proximate to its top end. The slot 56 receives a threaded bolt which extends perpendicularly from the gable clamp 30 so that the leg 50 may be pivoted and moved along its longitudinal axis. The position of the leg 50 may be fixed relative to the gable clamp 30 by tightening a wing nut 54 onto the end of the bolt so that the leg 50 is clamped between the wing nut 54 and the surface of the gable clamp 30.

The leg 50 also has a tab 58 integrally and perpendicularly extending therefrom (hidden in FIG. 1 and shown in phantom lines), thereby defining a notch in leg 50 proximate to the bottom end of the leg 50. The tab 58 has an edge perpendicular to the longitudinal axis of the leg 50.

In use, the tab 58 is perpendicular to the wall and brickwork, while the leg 50 is substantially parallel to the wall. The tab 58 helps to position the gable clamps 30 so that the mason's guide line 20 is held in the gable clamps 30 at a distance above a previously laid course of bricks equal to the thickness of a single course of bricks. This is accomplished by positioning the leg 50 on the gable clamps 30 so that the tab 58 is a predetermined distance below the line holder 42. The predetermined distance is determined by the desired thickness of a single course of bricks. Next, the leg 58 is fixed in that position. The gable clamps 30 are attached to the angle irons 10, or to the gable face boards B, so that the tab 58 is in contact with the top surface of the previously laid course of bricks.

Turning now to situations when the gable clamp device 5 is used to help brick-in a gable having a standard size roof overhang of approximately 4.5 inches, the first step is to fix the leg 50 on the gable clamps 30. The leg 50 is fixed so that the tab 58 is a distance below the line holder 42 equal to the desired thickness of a single course of bricks. The gable clamps 30 are then attached directly to the opposed and upwardly sloping gable face boards B by placing the channel shaped member 32 around the edge of the gable face board B and twisting the thumb screw 36 until the gable face board B is clamped between the clamping member 40 and the opposite sidewall 34B. This should be done so that the tabs 58 are in contact with the top surface of the most recently laid course of bricks or the top of a level surface on which a first course of bricks is to be laid.

The mason's guide line 20 is then placed in the line holder 42 of the gable clamps 30 so that it is strung tightly and horizontally across the gable A about 4.5 inches in front of the wall being bricked in. The next course of bricks is laid at this point using the mason's guide line 20 as a reference. When this is completed the process is repeated until the gable is completely bricked-in.

Figure 2:
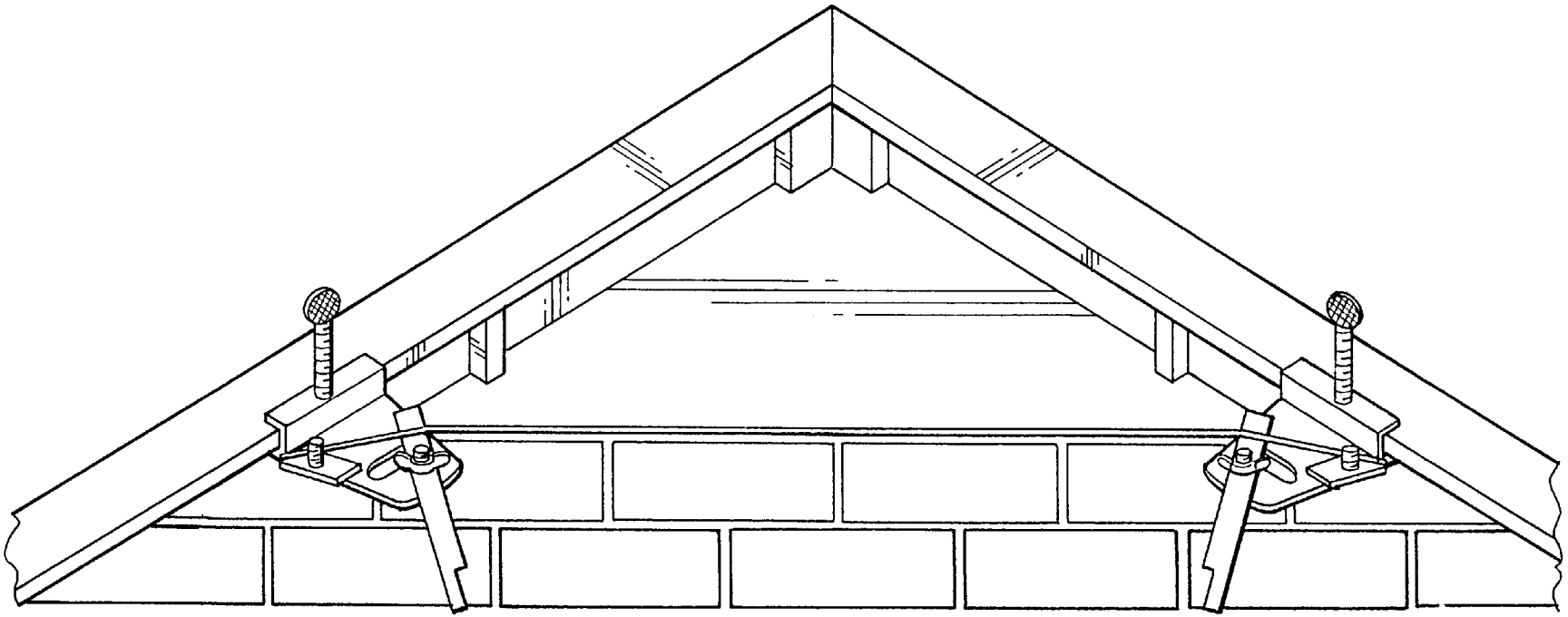
FIG. 2 PRIOR ART
FIG. 2 is an environmental perspective view of the prior art gable clamp device.

The above described process, which is consistent with the use of known gable clamp devices as illustrated in FIG. 2., which prior art devices will not work with a gable overhang much greater than 4.5 inches. When a gable overhang is greater than 4.5 inches and the gable clamps 30 are attached directly to the gable face boards B, the mason's guide line 20 would be positioned more than 4.5 inches in front of the wall being bricked-in. This is significant because a standard size brick is approximately 4.5 inches across from front to back and, by holding the mason's guide line 20 more than 4.5 inches away from the wall being bricked-in, it becomes more difficult to insure that a next course of bricks being laid is aligned with the mason's guide line 20. This margin of error is significantly magnified with regard to a large roof overhang which would cause the mason's guide line 20 to be held a several inches away from the front brick surface by a prior art device.

Thus, turning now to situations when the gable clamp device 5 is used to help brick in a gable A having a large roof overhang, as is illustrated in FIG. 1., the first step is to attach the angle irons 10 to the underside of the gable A by driving a nail, screw, or other mechanical fastener through the plurality of holes 16 in the securing beam 12 and into the gable 10. By doing such, the clamping beam 14 of the angle irons 10 extends perpendicularly from the gable A and parallel to the face boards B, thus allowing the angle irons 10 to essentially replace the gable face boards B in use.

The next step is to fix the leg 50 on the gable clamps 30 so that the tab 58 is a distance below the line holding means equal to the desired thickness of a single course of bricks. Then the gable clamps 30 are attached directly to the opposed and upwardly sloping angle irons 10 by placing the channel shaped member 32 around the clamping beam 14 and twisting the thumb screw 36 until the clamping beam 14 of the angle iron 10 is clamped between the clamping member 40 and the opposite sidewall 34B.

The above should be done so that the tabs 58 are in contact with the top surface of the most recently laid course of bricks or the top of a level surface on which a first course of bricks is to be laid. The mason's guide line 20 is then placed in the line holder 42 of the gable clamps 30 so that it is strung tightly and horizontally across the gable A about 4.5 inches in front of the wall being bricked in. The next course of bricks is laid at this point using the mason's guide line 20 as a reference. When this is completed the process is repeated until the gable is completely bricked-in.

It is to be understood that the present invention is not limited to the embodiment described above, but encompasses any and all embodiments within the scope of the following claims.

I claim:

1. A gable clamp device for holding a brick mason's guide comprising:

a pair of angle irons, each of said angle irons having a securing beam and a fastening beam, wherein said securing beam and said fastening beam are joined together so that each said angle iron is L-shaped; said securing beam including a plurality of holes disposed about the longitudinal axis of said securing beam for receiving a fastening means, whereby said securing beam may be attached to the underside of a gable with said fastening beam depending substantially perpendicular therefrom;

a mason's guide line; and a pair of gable clamps each including:

a body;

a fastener for releasably attaching to one of said fastening beams; and a line holder for holding said mason's guide line.

2. The gable clamp device as defined in claim 1 wherein said fastener is defined by said body including a channel shaped member having first and second spaced sidewalls, said first sidewall being adapted to receive said fastening beam of one of said angle irons and said second sidewall having a threaded hole formed therethrough; and a thumb screw inserted through said threaded hole, said thumb screw having a length greater than the spaced distance between said first and said second sidewalls, said thumb screw having a first end disposed outside of said channel shaped member and a finger grip formed thereon and further having a second end having a clamping member thereon disposed between said first and said second sidewalls of said channel shaped member, said clamping member being adapted to bear against said clamping beam.

3. The gable clamp device as defined in claim 1 wherein said gable clamps further comprises:

a leg pivotally and slidably mounted thereon for spacing said mason's guide line held in said line holder from the last course of bricks laid a predetermined distance equal to the thickness of a course of bricks.

4. The gable clamp device as defined in claim 3, wherein said gable clamp includes a threaded bolt depending perpendicularly from said body and wherein said leg has a slot formed therethrough along the longitudinal center thereof, said bolt passing through said slot and a wing nut threadedly disposed on said threaded bolt.

5. The gable clamp device as defined in claim 4, wherein said leg further comprises a tab extending perpendicularly from said leg, said tab for bearing against the top surface of a completed course of brick; whereby said leg may be positioned on said gable clamp so that said tab is positioned a distance below said line holder equal to the thickness of a course of bricks.

6. The gable clamp device as defined in claim 1, further including a plurality of fastening means for passing through a said hole of said securing beam.

7. A method of laying a course of bricks of a gable wall under a gable including a gable face board and a gable soffit, employing a pair of gable clamps each adapted for attachment to a gable face board, comprising the steps of:

attaching an angle iron to each gable soffit parallel to the gable wall and at a predetermined distance from the gable wall;

attaching each gable clamp to each angle iron attached to the gable soffit;

positioning each gable clamp at the predetermined distance from the gable wall at a predetermined height above a course of bricks to be laid; and stringing a mason's guide line from gable clamp to gable clamp.

* * * * *